US005391054A

United States Patent [19]

Bush

[11] Patent Number: 5,391,054

[45] Date of Patent: Feb. 21, 1995

[54] COMPRESSOR END SHELL

[75] Inventor: James W. Bush, Skaneateles, N.Y.

[73] Assignee: Carrier Corporation, Syracuse, N.Y.

[21] Appl. No.: 912,356

[22] Filed: Jul. 13, 1992

[51] Int. Cl.[6] ..... F01D 25/24

[52] U.S. Cl. ..... 415/182.1; 418/55.1; 220/DIG. 13; 417/902

[58] Field of Search ..... 415/182.1, 245 R, 245 A; 418/55.1; 220/DIG. 13, 601, DIG. 6; 417/902, 312

[56] References Cited

U.S. PATENT DOCUMENTS 4,431,383 2/1984 Boehmler et al. ..... 417/312
4,729,723 3/1988 Outzen ..... 417/312
4,904,165 2/1990 Fraser, Jr. et al. ..... 418/55.1
5,141,420 8/1992 Nambiar ..... 417/902

FOREIGN PATENT DOCUMENTS 0599766 9/1946 United Kingdom ..... 220/DIG. 6

*Primary Examiner*—John T. Kwon
*Assistant Examiner*—Mark Sgantzos

[57] ABSTRACT

An end shell for a hermetic compressor is formed from a sheet of metal. When formed, the end shell has a spherical surface which extends for at least 230° of the circumference of said end shell. If necessary or desired, a portion of up to 90° of the circumference of said end shell can be formed as a cylindrical segment in order to provide a radial discharge or the like.

5 Claims, 2 Drawing Sheets

COMPRESSOR END SHELL

BACKGROUND OF THE INVENTION

Commercially available hermetic compressors, including scroll and rotary types, have cylindrical shells with one or more end caps which are attached to the cylindrical shell by welding. The top end cap of a low side hermetic scroll compressor defines, in part, the discharge plenum and may have structure such as a muffler, separator plate, discharge check valve, etc. located therein. The bottom end cap, if present, typically defines the oil sump. In the case of a horizontal compressor, the sump is at least partially located within the cylindrical shell. In order to maximize the internal volume while maintaining minimum size, the end shells have a cylindrical portion and are typically flattened off with a relatively large spherical radius. This design is exemplified by commonly assigned U.S. Pat. No. 4,946,361 which also shows the presence of a cylindrical portion as a location of the radial discharge line. The end cap thus has a first cylindrical portion, an ess shaped transition that provides a shoulder and transitions into a second, smaller diameter cylindrical portion and a large, spherically radiused, relatively flat circular area. The essentially flat, circular area, if mechanically excited to resonance by vibration or pressure pulsation, can act as a drumhead and become a significant and objectionable radiator of sound.

SUMMARY OF THE INVENTION

The cylindrical portion of a conventional end shell is the location for a radial discharge line but the relatively flat circular area is the location for an axial discharge. In the case of a radial discharge the cylindrical area location provides a less direct flow path so as to increase the dwell time of the gas in the discharge chamber and the muffling effect while reducing the overall axial height/length. The present invention maintains a cylindrical portion to provide a location for a radial discharge line but it has a greatly reduced circumferential extent, preferably 90°, or less. For the remainder of the circumferential extent, the portion corresponding to the cylindrical portion has been eliminated which results in the corresponding axial extent being available to be a part of the curve forming the dome. As a result, a smaller radius defines the dome with a resultant reduction of the essentially flat circular area. This is achieved by not blending an ess transition into a second cylindrical position but, rather, after some lesser angle of transition, the ess blends directly into a spherical radius thereby eliminating the second cylindrical section.

The end result is a shell which provides the shoulder necessary for seating of the separator plate and a spherical end radius of the smallest possible size while maintaining some independently specified overall height.

The benefit of providing the smallest possible spherical end radius lies in the stiffening effect on the structure. Such an effect raises the natural frequencies of vibration, moving them away from the frequency ranges in which such events as mechanical impacts and pressure pulsations have their strongest energy content. The resulting increased mismatch in the frequencies of excitation and response result in radiation of a smaller portion of the available acoustic energy. The remainder is reflected internally and dissipated through viscous and other damping effects.

In this design it is necessary to provide a raised section or "nose" with a cylindrical outward-facing portion to provide for attachment of fittings such as discharge tubes and thermostat wells. Locally, this raised area provides a relatively flat or diaphragm-like surface which tends to have a low frequency of resonance. This runs counter to the stated objective. If, however, this region is limited in size, its effect can be minimized. Most of the benefit may be obtained with no more than about 65° for the raised portion.

Also of significance is the zone of transition between the raised area and the body of the domed end shell. A very short transition, in addition to being difficult to form, can reduce the resonance frequency of the upper shell. A long transition can have the same effect. Based on finite element analysis methods, a blend zone of about 20° is optimal. At 25°, there is a noticeable decrease in resonance frequency. Blend angles of 40° can be used with acceptable results.

It is an object of this invention to reduce sound radiation in a hermetic compressor.

It is another object of this invention to provide an end shell with a very high modal stiffness. These objects, and others as will become apparent hereinafter, are accomplished by the present invention.

Basically, an end shell for a compressor is provided with a spherical radius so as to avoid the formation of a significant relatively flat area tangential to the curved portion of the end shell. If necessary or desired, a cylindrical portion of limited circumferential extent is provided to locate a radial discharge.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 2:
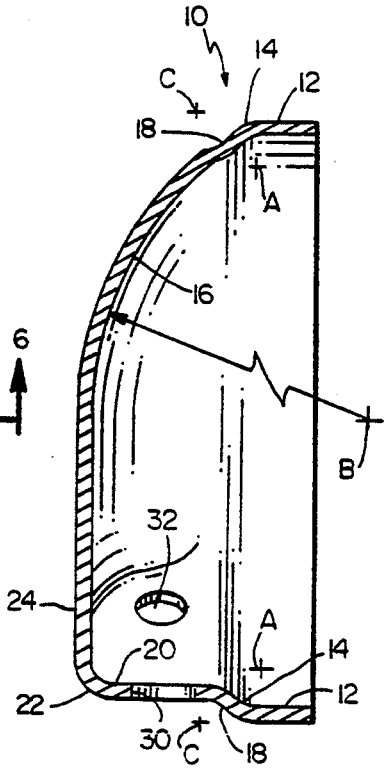
FIG. 2 is a sectional view taken along line 2—2 of FIG. 1.
Figure 4:
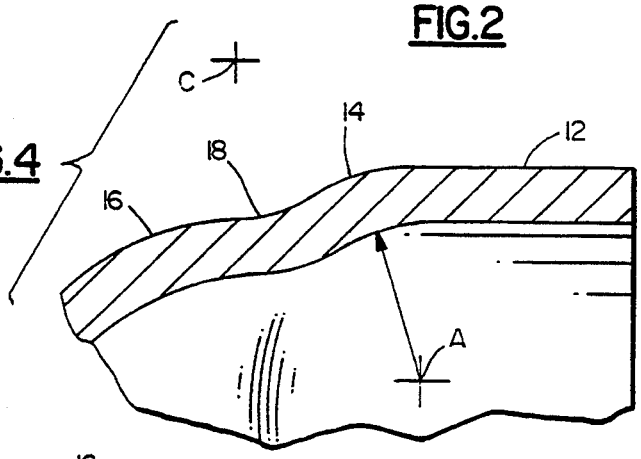
FIG. 4 is an enlarged view corresponding to the top portion of FIG. 2.
Figure 3:
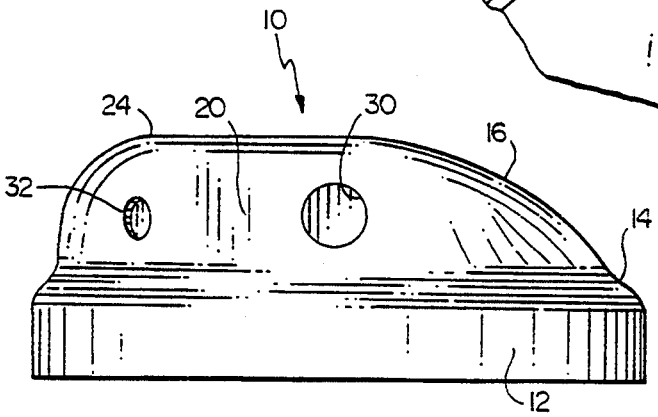
FIG. 3 is a side view looking in the direction of line 2—2 of FIG. 1.
Figure 6:
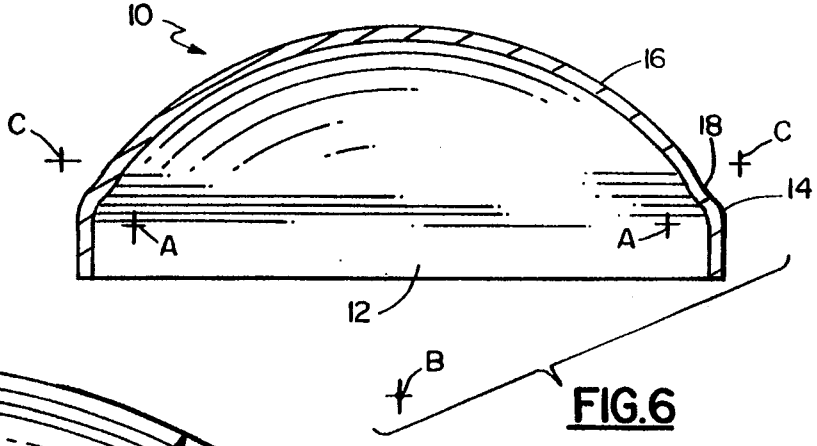
FIG. 6 is a sectional view taken along line 6—6 of FIG. 1.

In the Figures, the numeral 10 generally designates an end shell formed from sheet metal, specifically the discharge end of a hermetic compressor having a radial discharge. As best shown in FIGS. 2,4 and 6, end shell 10 has an open end defined by a cylindrical portion 12. Cylindrical portion 12 is welded to the main shell of a hermetic compressor and the main shell, and possibly a separator plate, are commonly received within the cylindrical portion 12 as part of the assembly process. Cylindrical portion 12 terminates in an annular curved portion 14 having a center represented in FIGS. 2 and 4–6 by points A which are located on a circle spaced from curved portion 14 by its radius of curvature.

If end shell 10 were to have an axial discharge or just define a closed area such as an oil sump, then the entire curved portion 14 would be part of an ess and blend into curved portion 18 having a center represented in FIGS.

Figure 1:
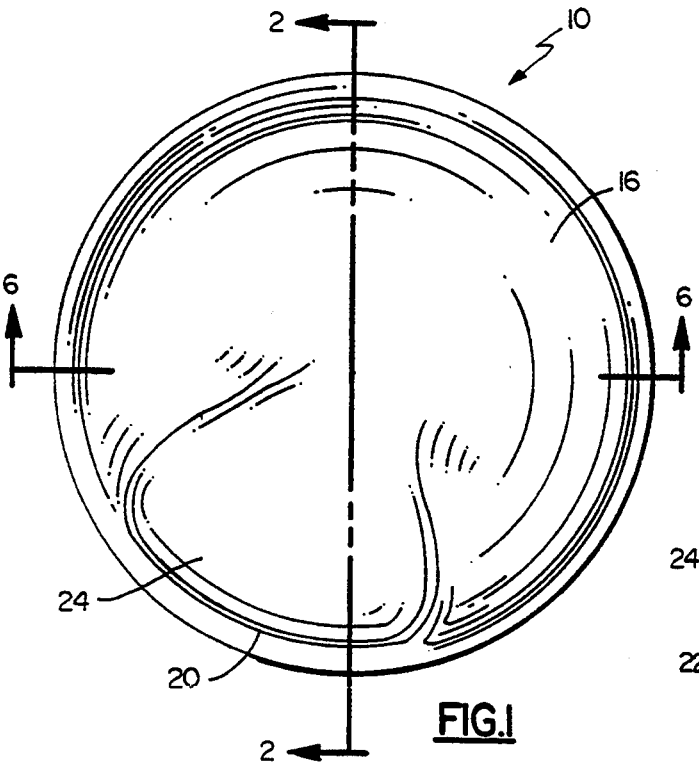
FIG. 1 is an end view of a compressor end shell.

2 and 4–6 by points C which are located on a circle spaced from curved portion 18 by its radius of curvature. The entire curved portion 18, in turn, would blend into curved surface 16 which is a portion of a sphere having B as its center. The radius of curved surface 16 is preferably a little larger than the radius of cylindrical portion 12 but less than 50% larger. However, as illustrated, end shell 10 has a radial discharge opening 30 located in a cylindrical portion 20. As best shown in FIG. 1, cylindrical portion 20 has a circumferential extent of 90°, or less. Cylindrical portion 20 circumferentially blends with spherical surface 16 through curved portion 22 and essentially flat portion 24. As best shown in FIG. 1, the flat portion 24 is essentially in the shape of a sector which becomes tangential to and blends into the spherical surface 16 as well as transitioning along a generally radial direction as cylindrical portion 20 blends into spherical surface 16. At the circumferential extent of cylindrical portion 20 the blend with the spherical surface 16 will be a continuation of curved surface 18 but with a displacement of the center represented by point C and a variation in radius dictated by the relative dimensions of the various parts and radii such as the axial extent of spherical surface 16. To provide access for a probe, radial port 32 is provided.

From the foregoing it should be clear that flat portion 24 is limited in area and that FIG. 6 represents the cross section for at least 230° of the circumference. In a typical example the flat portion 24 could be 45° in extent and the blends on either side could be 40° in extent leaving 235° of spherical surface but with the blends transitioning between spherical and flat. Since a flat portion is the area prone to vibration like a drumhead, the providing of a curved surface 16 of relatively small radius and limiting the size of flat portion 24 greatly reduces the tendency for vibration and raises the frequency of vibration as compared to a larger relatively flat area associated with a larger radius curved section.

Figure 5:
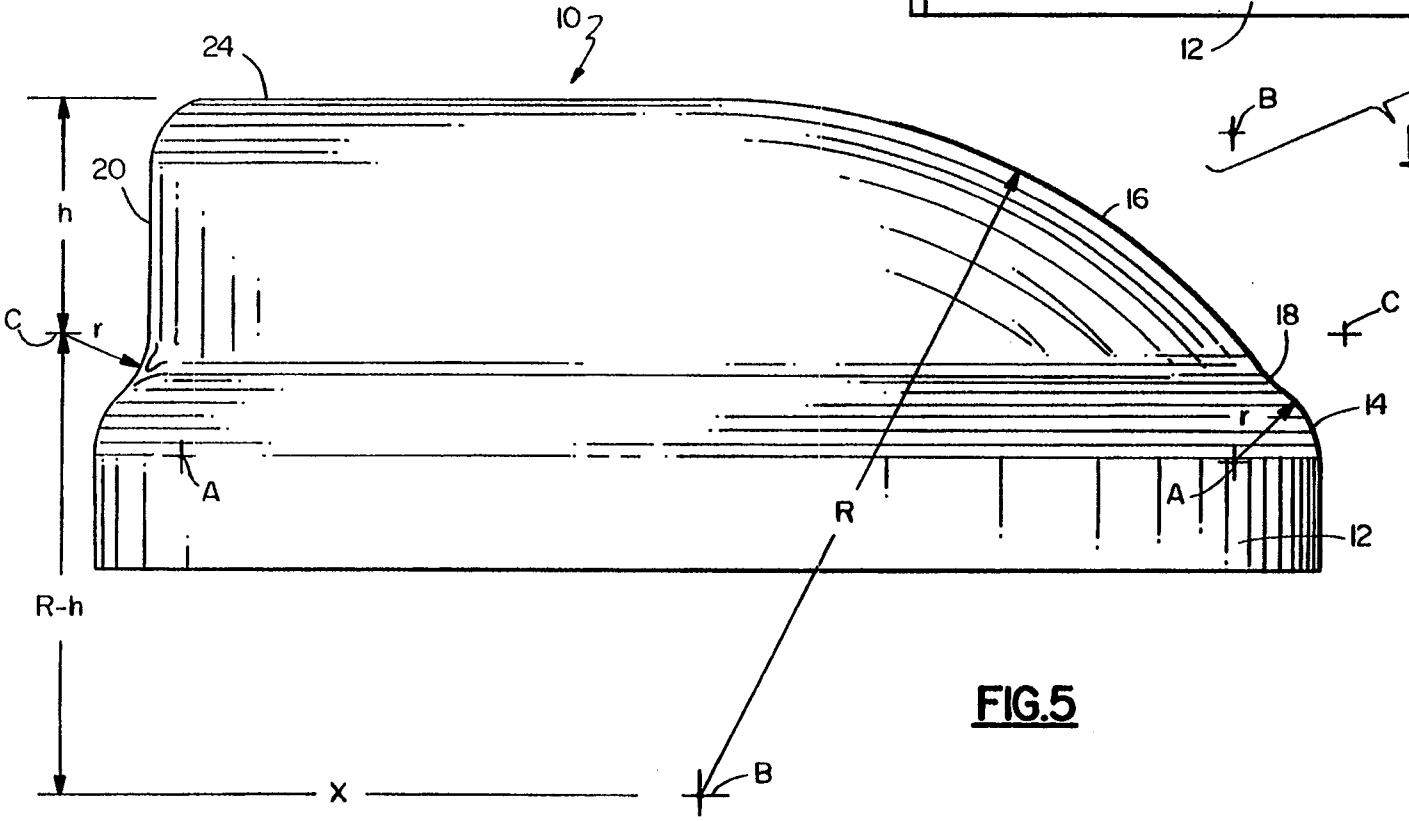
FIG. 5 is a simplified Figure corresponding to an unsectioned FIG. 2.

FIG. 5 corresponds to FIG. 2 but ignores the thickness of end shell 10 since, in practice, the dimensions will be to either the inside or the outside surface of the shell 10. FIG. 5 depicts the outer surface but the relationship described below may be applied to the inner surface without modification. In FIG. 5, R is the radius of the spherical surface 16, r is the radius of the curved portion 18, h is the axial extent of end shell 10 beyond point C, and X is the radial distance of point C from the axis of end shell 10. The radius of 14 is also illustrated as r, but, as noted, this is actually for the inner curved surface and the radius of 14 does not actually appear in the equation which follows. With B-C being the hypotenuse of a right angle having legs X and R-h, you can solve for R, the only unknown, to obtain $$R=(X^2+h^2-r^2)/2(r+h)$$

As noted above R is less than 150% of the radius of end shell 10.

Although a preferred embodiment of the present invention has been illustrated and described, other changes will occur to those skilled in the art. It is therefore intended that the scope of the present invention is to be limited only by the scope of the appended claims.

What is claimed is:

1. An end shell comprising:

an annular cylindrical portion having a first end and a second end with said first end being open and adapted for connection to a shell of a hermetic compressor;

a first annular curved portion extending radially inward from said second end;

a second annular curved portion coacting with said first annular curved portion to form an ess;

a spherical surface blended into said second annular curved portion for at least 230° of said second annular curved portion.

2. The end shell of claim 1 further including an axially extending cylindrical portion blended into said spherical surface.

3. The end shell of claim 2 wherein said axially extending cylindrical portion and said second annular curved portion are blended through a segmental curved portion.

4. The end shell of claim 1 wherein said spherical surface has a radius greater than 100% of and less than 150% of that of said annular cylindrical portion.

5. The end shell of claim 1 wherein said first annular curved portion and said second annular curved portion blend into each other to form said ess.

* * * * *